US011242675B2

(12) United States Patent
Chung

(10) Patent No.: US 11,242,675 B2
(45) Date of Patent: Feb. 8, 2022

(54) ARTICULATING FAUCET

(71) Applicant: Kohler Co., Kohler, WI (US)

(72) Inventor: Chanseol Chung, Milwaukee, WI (US)

(73) Assignee: Kohler Co., Kohler, WI (US)

( * ) Notice: Subject to any disclaimer, the term of this patent is extended or adjusted under 35 U.S.C. 154(b) by 87 days.

(21) Appl. No.: 16/429,981

(22) Filed: Jun. 3, 2019

(65) Prior Publication Data

US 2019/0368173 A1 Dec. 5, 2019

Related U.S. Application Data

(60) Provisional application No. 62/680,280, filed on Jun. 4, 2018.

(51) Int. Cl.
*E03C 1/04* (2006.01)

(52) U.S. Cl.
CPC ..... *E03C 1/0404* (2013.01); *Y10T 137/9464* (2015.04)

(58) Field of Classification Search
USPC ..... 137/801
See application file for complete search history.

(56) References Cited

U.S. PATENT DOCUMENTS 1,138,187 A * 5/1915 Bridges ..... F16K 31/58 137/616.7
2,878,059 A * 3/1959 Limle ..... E03C 1/0404 239/26
4,735,357 A * 4/1988 Gregory ..... E03C 1/057 137/801
4,768,557 A * 9/1988 Holzer ..... E03C 1/0404 137/616
5,062,164 A * 11/1991 Lee ..... E03C 1/057 4/677
5,342,018 A * 8/1994 Wu ..... F16K 31/54 251/250
5,755,262 A * 5/1998 Pilolla ..... E03C 1/055 137/625.17
5,868,311 A * 2/1999 Cretu-Petra ..... E03C 1/057 236/12.12
2006/0192161 A1* 8/2006 Kuna ..... E03C 1/0404 251/95

(Continued)

FOREIGN PATENT DOCUMENTS

CN 201322115 Y 10/2009
CN 203453524 U 2/2014
CN 204628724 U 9/2015

(Continued)

OTHER PUBLICATIONS

CN 204628724 U Translation, 2015, Machine Translation (Year: 2015).*

(Continued)

*Primary Examiner* — Daphne M Barry
(74) *Attorney, Agent, or Firm* — Foley & Lardner LLP

(57) ABSTRACT

A faucet having a base that is mountable to a support, a spout moveably coupled to the base and having an outlet for dispensing water, and a valve that controls a flow of water to an outlet, where the valve is opened in response to the spout being moved relative to the base to a first position, and the valve is closed in response to the spout being moved relative to the base from the first position toward a second position.

23 Claims, 12 Drawing Sheets

(56) References Cited

U.S. PATENT DOCUMENTS

| | | | | |
|---|---|---|---|---|
| 2016/0215482 | A1 | 7/2016 | Fourman et al. | |
| 2019/0264838 | A1 * | 8/2019 | Chung | E03C 1/0404 |

FOREIGN PATENT DOCUMENTS

| | | | | |
|---|---|---|---|---|
| CN | 105822791 | A | 8/2016 | |
| WO | WO-2015010251 | A1 * | 1/2015 | E03C 1/0403 |

OTHER PUBLICATIONS

WO-2015010251-A1, Machine Translation (Year: 2015).*
Chinese First Office Action issued on Chinese Patent Application No. 201910476155.5, with English Summary, dated Jul. 15, 2020, 15 pages.

* cited by examiner

FIG. 8
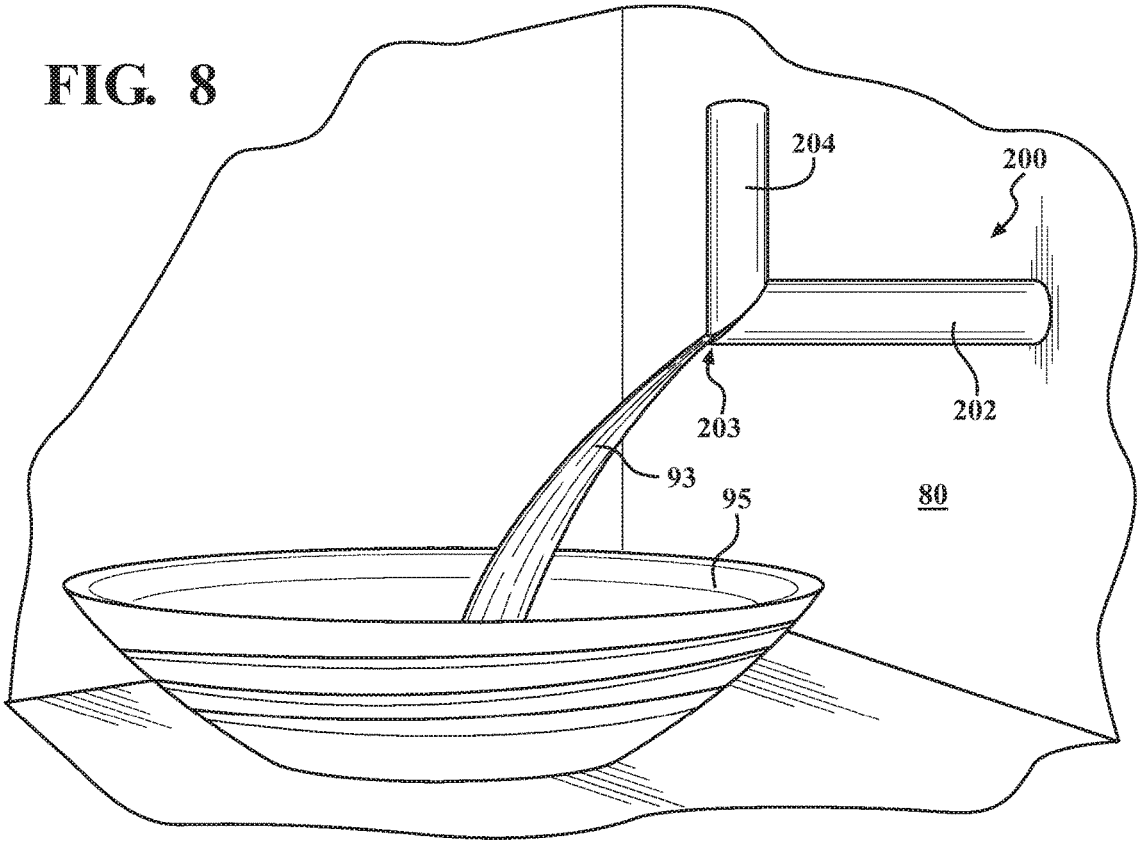
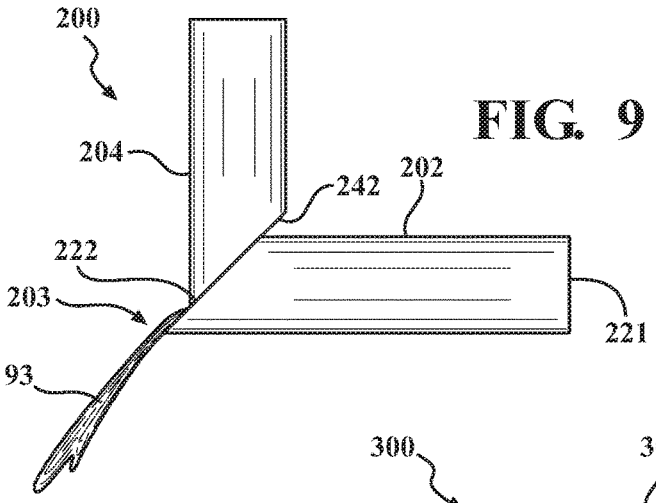
FIG. 9
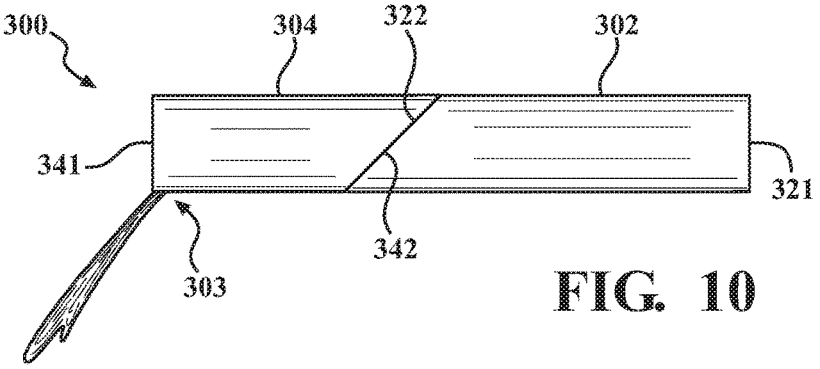
FIG. 10

FIG. 12
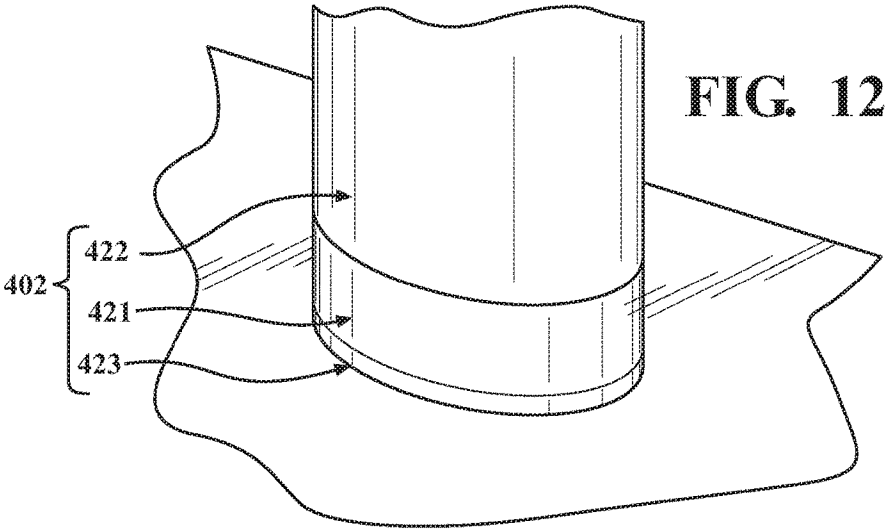
FIG. 13
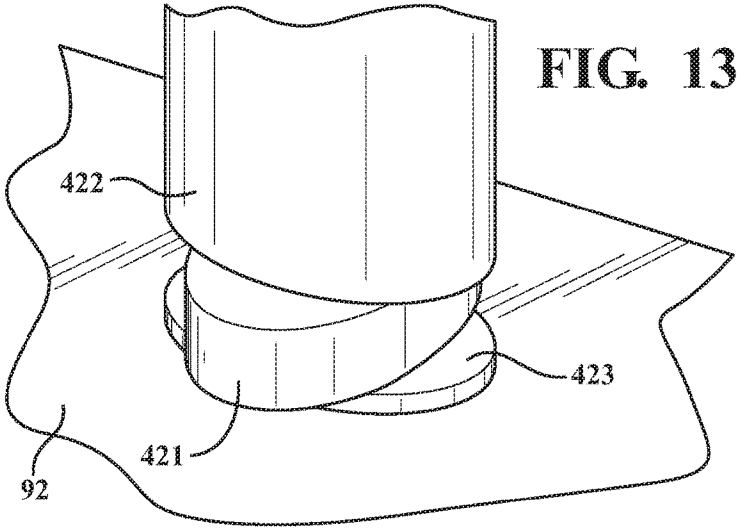
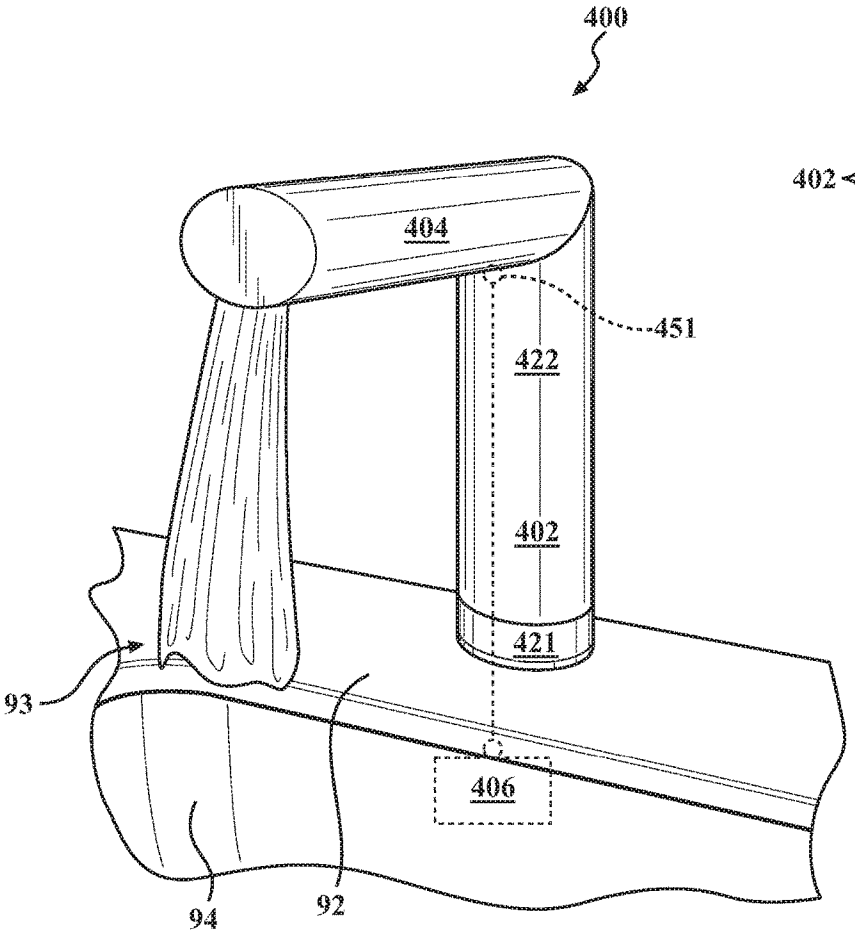
FIG. 11

Pivot action for first embodiment
From off to on
Need to turn up to 90° (270° if counter clockwise) degree
and it automatically goes to 180° (on) position
From on to off
Need to turn up to 270° (90° counter clockwise) degree
and it automatically goes to 0° (off) position

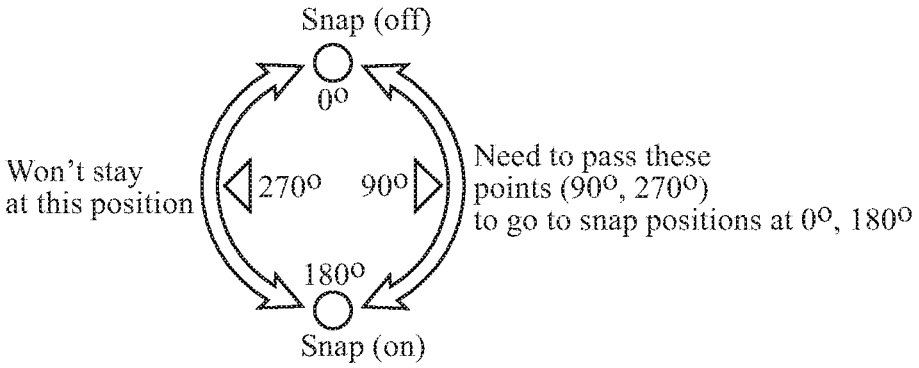

FIG. 20

Pivot action for second embodiment
From off to on
Need to turn up to 20° (340° if counter clockwise) degree
and it automatically goes to 180° (on) position with slowing down
from 160° (340°) to 180° position
From on to off
Need to turn up to 200° (160° if counter clockwise) degree
and it automatically goes to 0° (off) position

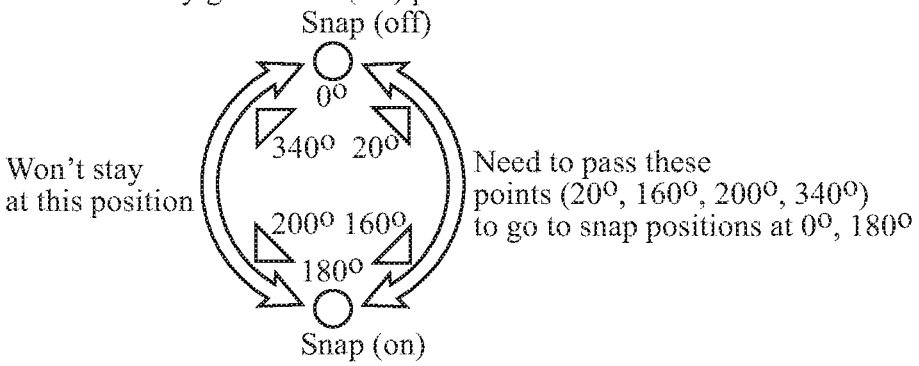

FIG. 21

ARTICULATING FAUCET

CROSS-REFERENCE TO RELATED PATENT APPLICATIONS

This application claims priority to and the benefit of U.S. Provisional Patent Application No. 62/680,280, filed on Jun. 4, 2018. The foregoing application is incorporated herein by reference in its entirety.

BACKGROUND

The present invention relates generally to the field of faucets. More specifically, the present application relates to articulating faucets that control the operation of the faucets through articulation of the spout relative to the base.

SUMMARY

At least one embodiment of the application relates to a faucet that includes a base configured to mount to a support, a spout operatively coupled to the base and having an outlet for dispensing water, a water line passing through the base and the spout to fluidly connect to the outlet, and a valve configured to control a flow of water to the outlet of the spout in response to a first movement of the spout relative to the base.

At least one embodiment relates to a faucet that includes a base mountable to a support, a spout moveably coupled to the base and having an outlet for dispensing water, a valve that controls a flow of water, and a fluid conduit fluidly connecting the valve and the outlet. The valve is opened in response to the spout being moved (e.g., rotated) relative to the base to a first position, and the valve is closed in response to the spout being moved (e.g., rotated) relative to the base from the first position toward a second position.

At least one embodiment relates to a faucet having a base mountable to a support; a spout moveably coupled to the base and having an outlet for dispensing water; and a valve that controls a flow of water to the outlet. The valve is opened in response to the spout being moved relative to the base to a first position, and the valve is closed in response to the spout being moved relative to the base from the first position toward a second position.

At least one embodiment relates to a faucet having a base mountable to a support; a spout moveably coupled to the base and having an outlet for dispensing water; and a valve that controls a flow of water to the outlet. A first movement of the spout relative to the base opens/closes the valve. A second movement of the spout, which is different than the first movement, relative to the base adjusts a flow rate of the water through the valve.

At least one embodiment relates to a faucet having a base mountable to a support; a spout rotatably coupled to the base and having an outlet for dispensing water; and a valve that controls a flow of water to the outlet. The valve opens in response to at least one of a clockwise rotation and a counterclockwise rotation of the spout relative to the base to a first position. The valve closes in response to at least one of the clockwise rotation and the counterclockwise rotation of the spout relative to the base from the first position toward a second position. A longitudinal axis of the spout aligns with a longitudinal axis of the base in one of the first position or the second position

BRIEF DESCRIPTION OF THE DRAWINGS

FIG. 8 is a side perspective view of an exemplary embodiment of a faucet, according to this application.

FIG. 9 is a side view of the faucet shown in FIG. 8 in another position.

FIG. 10 is a side view of an exemplary embodiment of a faucet, according to this application.

FIG. 11 is a front perspective view of an exemplary embodiment of a faucet, according to this application.

FIG. 12 is a detail view of a portion of the faucet shown in FIG. 11.

FIG. 13 is another detail view of the portion of the faucet shown in FIG. 11.

FIG. 20 is a schematic showing operation of a faucet, according to an exemplary embodiment.

FIG. 21 is another schematic showing operation of a faucet, according to an exemplary embodiment.

DETAILED DESCRIPTION

Referring generally to the FIGURES, disclosed herein are articulating faucets that control the operation of the faucet (e.g., flow of water, temperature of water, etc.) based on articulation (e.g., rotation, sliding, etc.) of a part of the faucet, such as a spout, relative to another part of the faucet, such as a base. Traditional faucets rely on articulation of handles or actuation of sensors to control these operations. The faucets disclosed herein can, for example, turn on/off the flow of water through the faucet by a first articulation (e.g., rotation) of the spout relative to a base, and can further control the flow rate of the water from the faucet by a second articulation (e.g., sliding) of the spout relative to the base. The faucets of this application advantageously allow for clean and aesthetically pleasing designs (e.g., designs without handles and other separate controllers), while providing intuitive control of the functionality of the faucet.

Figure 1:
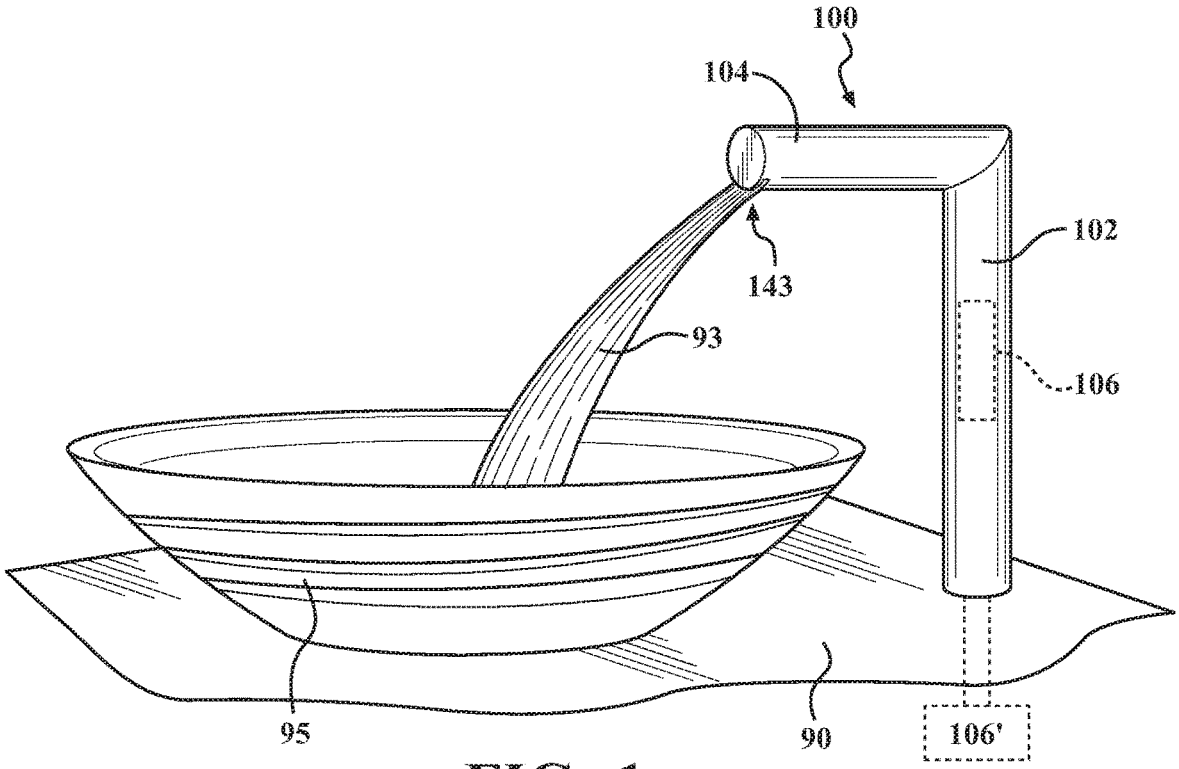
FIG. 1 is a front perspective view of an exemplary embodiment of a faucet in a first position, according to this application.
Figure 2:
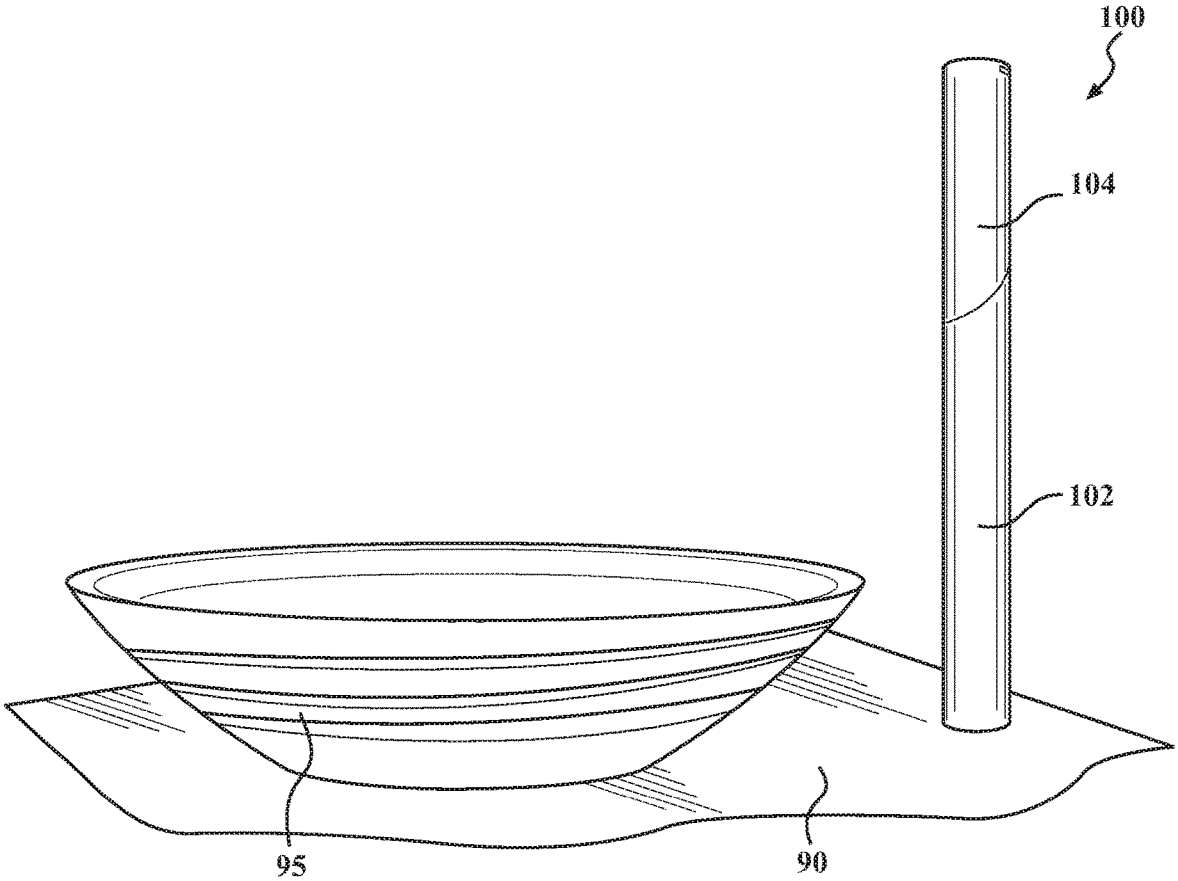
FIG. 2 is a front perspective view of the faucet shown in FIG. 1 in a second position.

FIGS. 1-7 illustrate an exemplary embodiment of a faucet 100 shown mounted to a countertop 90 and configured to discharge (e.g., emit, etc.) water 93 toward a sink 95 for washing and the like. As shown, the faucet 100 includes a base 102 and a spout 104. The base 102 fixedly or rotatably mounts to the countertop 90 and extends upwardly therefrom. The spout 104 couples to the base 102 and is movable relative thereto between a use position, in which the spout 104 extends transversely (e.g., horizontally) relative to the base 102 as shown in FIG. 1, and a non-use position, in which the spout 104 extends coincidentally (e.g., collinearly, in-line, etc.) with the base 102 as shown in FIG. 2. In the use position, the faucet 100 discharges water 93, whereas in the non-use position, no water discharges from the faucet 100. The faucet 100 includes a valve 106 that controls water flow through the faucet 100, and operation of the valve 106 is controlled by the movement of the spout 104 relative to the base 102. For example, movement of the spout 104 relative to the base 102 controls operation of the valve 106 (e.g., a flow of water, flow rate of water, temperature of water, etc.). As shown in FIGS. 1 and 2, the valve is open in the use position of the spout 104 allowing water to flow from an outlet of the spout 104, and the valve is closed in the non-use position of the spout 104 preventing water from flowing from the faucet 100 (e.g., to the spout 104/outlet). Movement (e.g., rotation) of the spout 104 from the use position toward the non-use position moves the valve from the open position to the closed position. The valve 106 can be located within the faucet 100 (in the base 102 or in the spout 104) or outside of the faucet 100 (see the valve 106') and fluidly connected to the base 102, such as through a fluid conduit therein.

Figure 3:
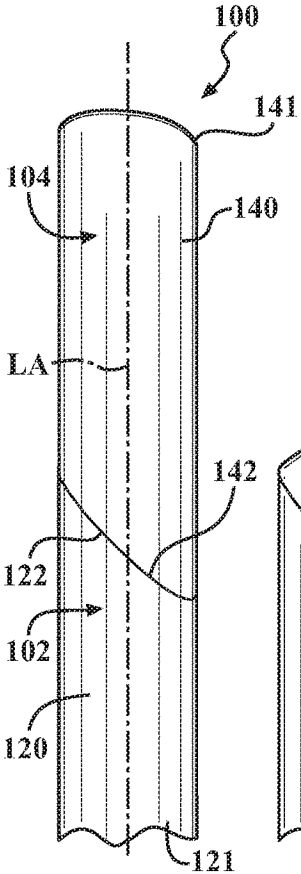
FIG. 3 is a side view of the faucet shown in FIG. 2 in the second position.

As shown in FIG. 3, the base 102 has a generally cylindrical shaped body 120 extending along a longitudinal axis LA from a first (e.g., mounting) end 121, which is mountable to a supporting surface, to a second end 122, which is operatively coupled to the spout 104. As shown, the first end 121 is generally orthogonal to the longitudinal axis LA such that the end surface on the first end 121 is circular, while the second end 122 is oblique to the longitudinal axis LA such that the end surface/plane on the second end 122 is elliptical.

Also shown in FIG. 3, the spout 104 has a generally cylindrical shaped body 140 extending along the longitudinal axis LA from a first (e.g., outlet) end 141, which includes an outlet 143 for discharging water from the spout 104 (FIG. 5), to a second end 142, which is operatively coupled to the second end 122 of the base 102. As shown, the first end 141 is generally orthogonal to the longitudinal axis LA in the non-use position such that the end surface on the first end 141 is circular, while the second end 142 is oblique to the longitudinal axis LA such that the end surface/plane on the second end 142 is elliptical. In the non-use position, the end surface/plane of the second end 142 of the spout 104 is proximate to (e.g., abuts) and has the same configuration (e.g., size, shape, etc.) as the second end 122 of the base 102, and the spout 104 complements the base 102 such together they form a cylindrical shaped faucet. Notably, the base 102 and/or the spout 104 can have shapes other than generally cylindrical, such as generally rectangular, square, elliptical, among other suitable shapes.

Figure 5:
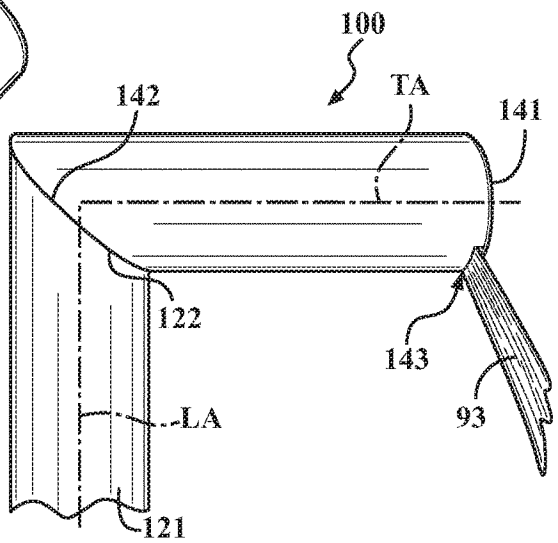
FIG. 5 is a side view of the faucet shown in FIG. 3 in the first position.
Figure 4:
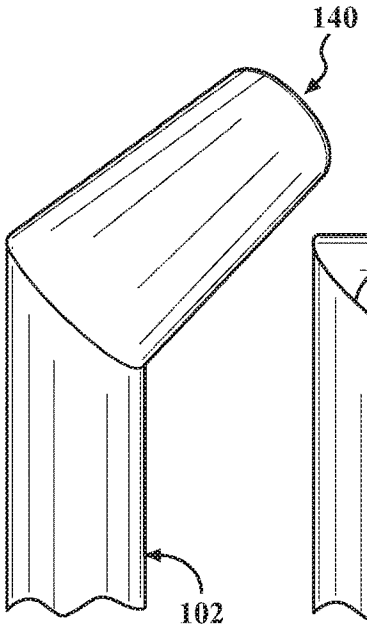
FIG. 4 is a side view of the faucet shown in FIG. 3 in an intermediate position between the first and second positions.

As shown in FIG. 4, the spout 104 is rotatable about the end surface/plane of the second end 142 and the end surface/plane of the second end 122 of the base 102. FIG. 4 shows the spout 104 rotated less than ninety degrees (90°) relative to the base 102, which corresponds to a point between the non-use and use positions. FIG. 5 shows the spout 104 rotated approximately ninety degrees (90°) relative to the base 102, which corresponds to the use position with water 93 discharging from the outlet 143 of the spout 104. Notably, the spout 104 can rotate in one or both directions (clockwise and counterclockwise) and, according to at least one embodiment is rotatable three hundred and sixty degrees (360°). As noted above, rotation of the spout 104 relative to the base 102 into the use position opens the valve to start the flow of water to the outlet 143 of the spout 104. In the use position, the spout 104 extends along a transverse axis TA that is transverse (e.g., orthogonal) to the longitudinal axis LA, such that the spout 104 and base 102 form a generally "L" shaped faucet 100 (e.g., generally at a right angle).

Figure 7:
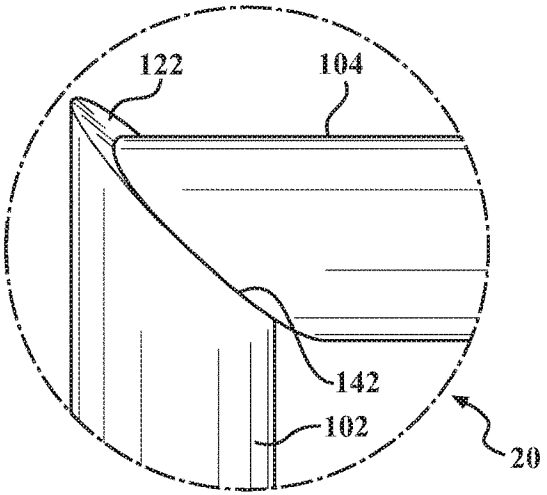
FIG. 7 is a detail view of a portion of the faucet shown in FIG. 6.
Figure 6:
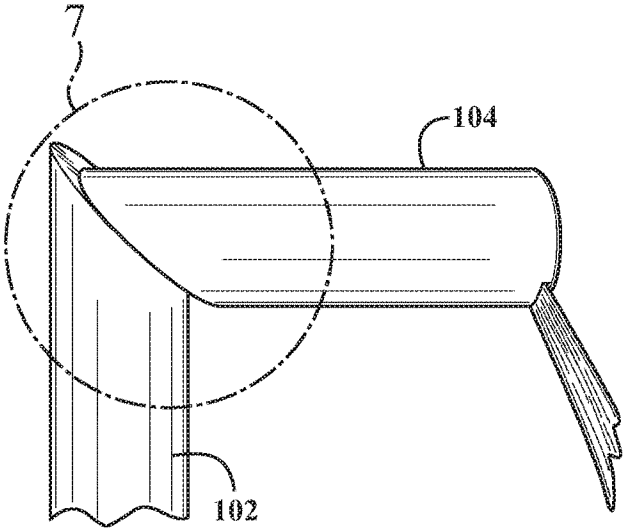
FIG. 6 is a side view of the faucet shown in FIG. 3 in a third position.

FIGS. 3-5 show that the spout 104 is moveable in a first movement (e.g., rotation) relative to the base 102 to turn on and off the flow of water from the spout 104. FIGS. 6 and 7 show that in the use position, the spout 104 is moveable in a second movement (e.g., sliding, translation, linearly, etc.) relative to the base 102 to control the flow rate and/or the temperature of water from the spout 104. Notably, the sliding movement does not have to be linear, as the spout 104 can slide along a non-linear path relative to the base 102. As shown, the second end 142 of the spout 104 slides along the second end 122 of the base 102 in a forward and downward direction (i.e., substantially along the plane formed by the end surface of the second end 122 of the base 102) to change the flow rate and/or temperature of the discharged water. For example, the spout 104 can slide between a full forward/downward position, which corresponds to a maximum flow rate, and a full rearward/upward position, which corresponds to a minimum flow rate.

FIGS. 8 and 9 illustrate an exemplary embodiment of a faucet 200 shown mounted to a vertically extending wall 80 and configured to discharge (e.g., emit, etc.) water 93 into the sink 95 for washing and the like. The faucet 200 includes a base portion 202 and an end portion 204 (e.g., spout, spout portion, etc.). The base portion 202 mounts (e.g., fixedly, rotatably, etc.) to the wall 80 and extends generally horizontally outward. The end portion 204 operatively couples and is movable relative to the base portion 202 between a use position and a non-use position. In the illustrated use position, the end portion 204 extends transversely (e.g., vertically) relative to the base portion 202 as shown in FIG. 8. In the use position, the valve is open and the faucet 200 discharges water 93 from an outlet 203 that is shown in FIG. 8 located proximate the interface between the end portion 204 and the base portion 202. In the non-use position, the end portion 204 extends coincidentally (e.g., collinearly, in-line, etc.) with the base portion 202 (like FIG. 10). In the non-use position, the valve is closed such that no water is discharged from the outlet 203 of the faucet 200. According to at least one embodiment, the valve turns on in response to rotation of the end portion 204 relative to the base portion 202 to the use position (FIG. 8), and the valve turns off in response to rotation of the end portion 204 relative to the base portion 202 from the use position toward the non-use portion. The valve can be located within or outside of the faucet 200. For example, the valve can be located within the base portion 202 or the end portion 204.

As shown in the FIG. 9, the outlet 203 is in an end 222 of the base portion 202 that is opposite the mounting end 221 and that interfaces with an end 242 of the end portion 204. A first movement (e.g., rotation about a longitudinal axis of the base portion 202) of the end portion 204 relative to the base portion 202 turns the flow of water from the outlet 203 on and off by opening and closing a valve of the faucet 200. A second movement (e.g., sliding, translation, linearly, etc.) of the end portion 204 relative to the base portion 202, such as along the oblique plane that the end portion 204 mounts to the base portion 202, controls the flow rate and/or the temperature of water from the outlet 203. As shown, the end 242 of the end portion 204 slides along the end 222 of the base portion 202 during the second movement of the end portion 204.

FIG. 10 illustrates another exemplary embodiment of a wall mountable faucet 300 that includes a base portion 302 and an end portion 304 that together form a generally cylindrical faucet in a use position (shown). The base portion 302 extends horizontally and has a first end 321 for mounting to the wall or other vertical object. The end portion 304 has an outlet 303 proximate a first (e.g., free, outer, etc.) end 341 and a second end 342 operatively coupled to a second end 322 of the base portion 302. A first movement (e.g., rotation about a longitudinal axis of the base portion 302) of the end portion 304 relative to the base portion 302 from a vertical configuration to a horizontal configuration (shown in FIG. 10) places the faucet in the use position by opening the valve so that water flows from the outlet 303. Rotation of the end portion 304 back toward a transverse (e.g., vertical) configuration places the faucet in the non-use position by closing the valve to prevent water from flowing from the outlet 303. Notably, the end portion 304 can rotate in a clockwise direction and/or a counterclockwise direction relative to the base portion 302 between the use and non-use positions. Also, the valve can be located within or outside of the faucet 300. Further, a flow rate and/or temperature of the water exiting the faucet 300 can be controlled by moving the end portion 304 relative to the base portion 302 in a second movement, such as sliding the end portion 304 along the second end 342 relative to the second end 322 of the base portion 302.

Figure 14:
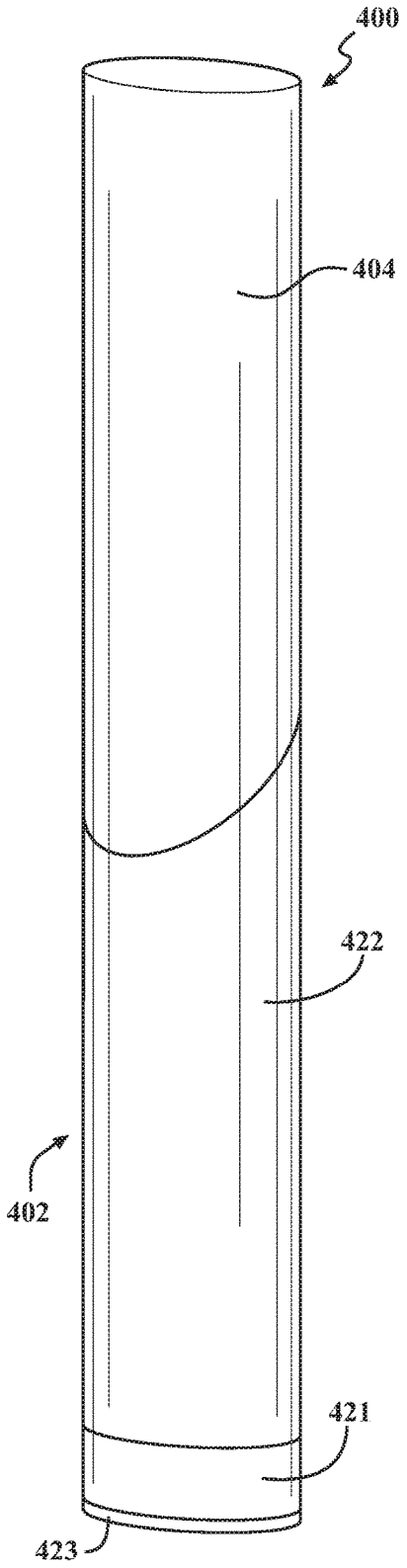
FIG. 14 is another front perspective view of the faucet shown in FIG. 11.

FIGS. 11-13 illustrate an exemplary embodiment of a faucet 400 shown mounted to a sink deck 92 of a sink 94 and configured to discharge (e.g., emit, etc.) water 93 toward the sink 94 for washing and the like. The faucet 400 is configured similar to the faucet 100 having a base 402, which is mounted to the sink deck 92 in an upwardly extending manner, and a spout 404, which is operatively coupled to the base 402. The spout 404 is movable in a first movement (e.g., rotation) relative to the base 402 between a use position and a non-use position. In the use position, the spout 404 extends transversely (e.g., horizontally) relative to the base 402 and the valve 406 is open so that water 93 flows from an outlet of the spout 404 (shown in FIG. 11). In the non-use position, the spout 404 extends coincidentally (e.g., collinearly, in-line, etc.) with the base 402 and the valve 406 is closed so that water does not flow from the outlet (FIG. 14). As shown in FIG. 11, the valve 406 is a solenoid valve that is mounted below the sink deck 92 and external to (e.g., outside of) the faucet 400. As shown in FIGS. 12 and 13, a portion 421 of the base 402 (e.g., lower portion, bottom portion, segment, etc.) is rotatable relative to an upper part 422 of the base 402 that supports the spout 404 to control the temperature of the water exiting the valve 406. The portion 421 is shown in FIG. 12 as substantially circular (e.g., disc, oval, elliptical, etc.) shaped, which complements the shape of the stationary upper part 422 in a first position, which can correspond to a maximum cold setting of the valve (e.g., while the hot water is shut off and the cold water is on). The portion 421 is shown in FIG. 13 rotated relative to the upper part 422 to a second position (e.g., ninety degrees), which corresponds to a maximum hot setting of the valve. Notably, rotating the portion 421 incrementally between the first and second positions results in incremental changes in the water temperature (increasing the temperature). Notably, the maximum hot and cold settings can be reversed to the first and second positions of the portion 421, respectively. The portion 421 can be configured to automatically return to the first position after the water is turned off, or the portion 421 can be configured to require manual rotation back to the first position after the water is turned off. Also shown in FIG. 13, the base 402 includes a mount 423 that rests on the sink deck 92 (or other supporting object), and the portion 421 is rotatable relative to the mount 423 as well as the upper part 422 of the base 402.

Figure 15:
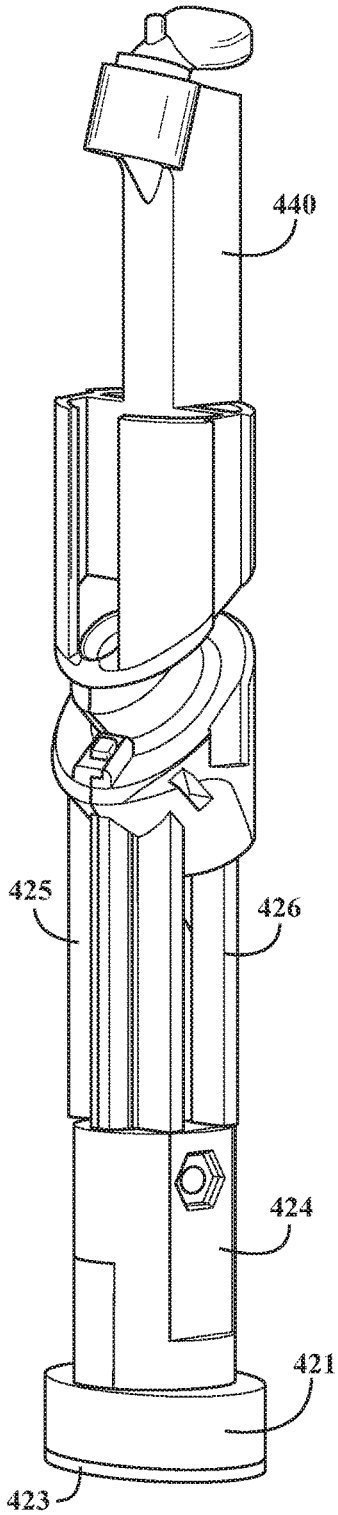
FIG. 15 is another front perspective view of the faucet shown in FIG. 14 with the shells/outer covers removed for clarity.
Figure 16:
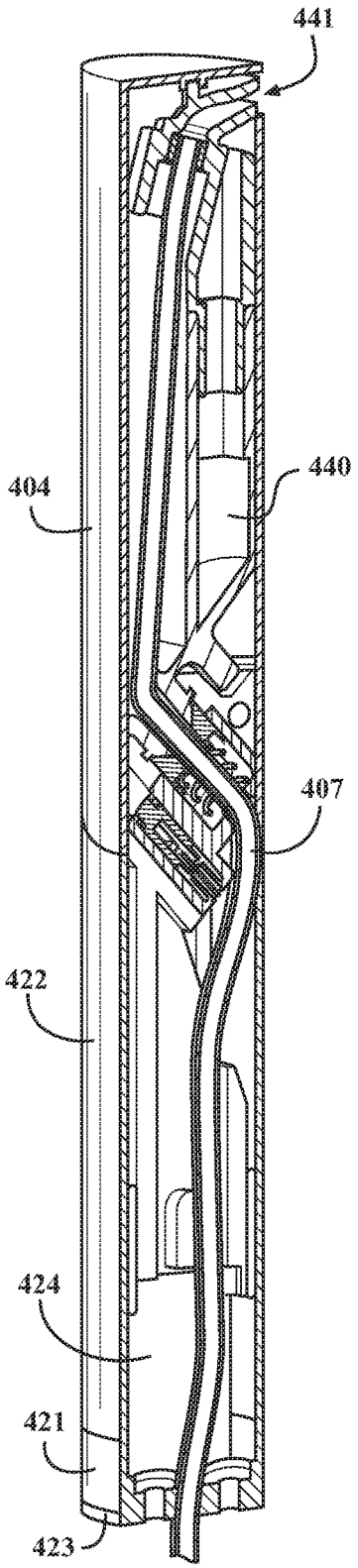
FIG. 16 is a partial cross-sectional front perspective view of the faucet shown in FIG. 14.
Figure 17:
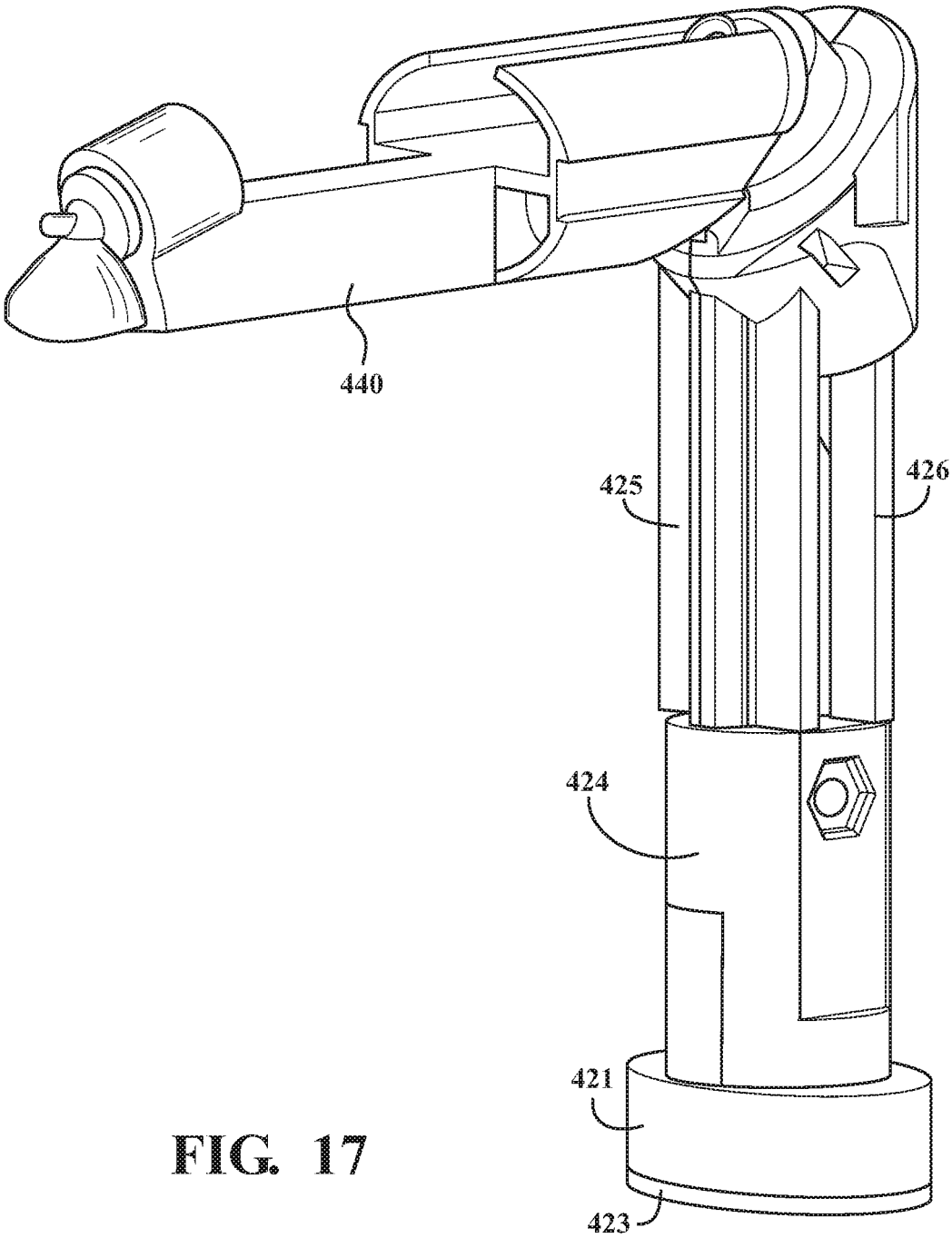
FIG. 17 is another front perspective view of the faucet shown in FIG. 11 with the outer covers removed for clarity.

FIG. 14 shows the faucet in the non-use position. FIG. 15 shows the faucet 400 in the non-use position with a shell (e.g., outer cover, skin, casing, etc.) of the spout 404 and a shell of the upper part 422 of the base 402 removed to show internal components of the faucet. FIG. 16 is a cross-sectional view taken approximately through the center of the faucet 400 shown in FIG. 14. As shown, a shoulder 424 extends upwardly from the mount 423 and through the portion 421. The shoulder 424 can rotatably support the portion 421, such that the portion 421 can rotate relative to the shoulder 424. Supported on the shoulder 424 are two clamshell parts 425, 426 of the base 402 that rotatably support a frame 440 of the spout 404. Extending through a bore in the shoulder 424, through the two clamshell parts 425, 426 and through the frame 440 is a fluid conduit 407 (e.g., hose, tubing, etc.) fluidly connecting an outlet 441 in the spout 404 to the valve 406. FIG. 17 shows the frame 440 in the use position, in which the frame 440 and the spout 404 are rotated by an angle (e.g., approximately ninety degrees) from the non-use position (shown in FIGS. 14-16) relative to the base 402.

Figure 19:
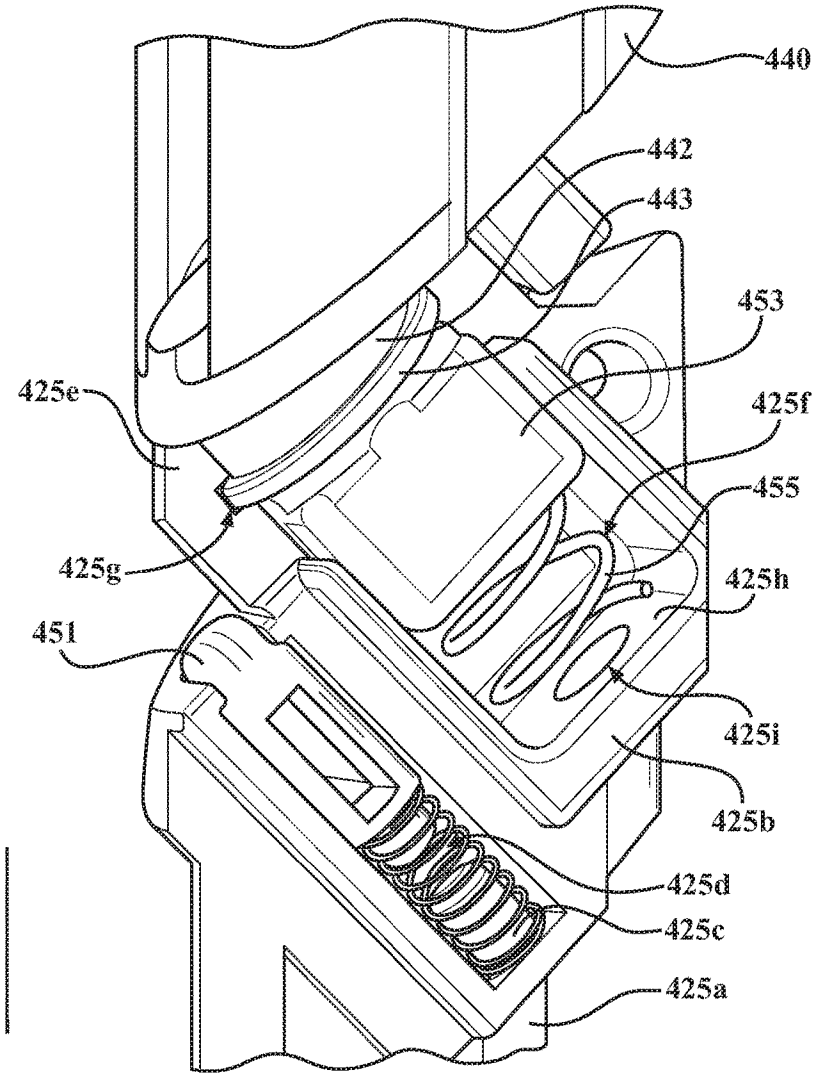
FIG. 19 is a side perspective view of the portion of the faucet shown in FIG. 18.
Figure 18:
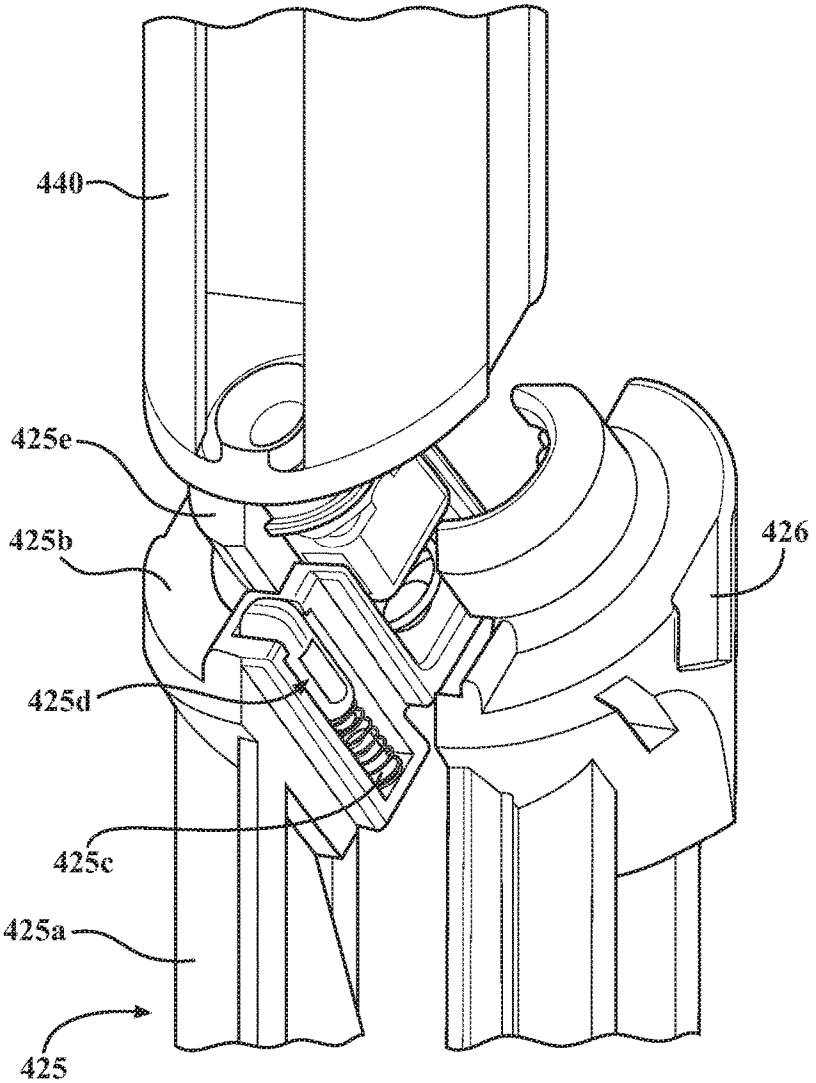
FIG. 18 is a front perspective view of a portion of the faucet shown in FIG. 14.
Figure 23:
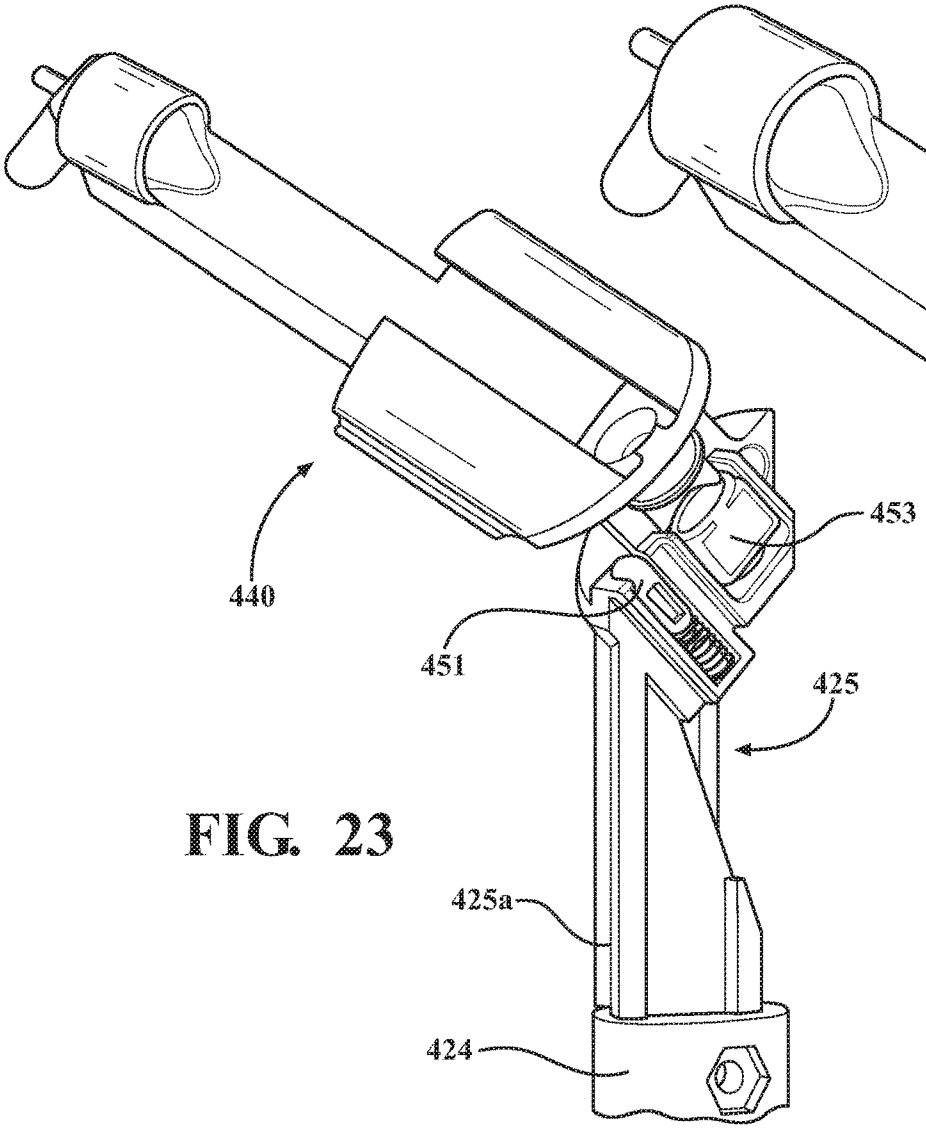
FIG. 23 is a side perspective view of another portion of the faucet shown in FIG. 14.

As shown best in FIGS. 18, 19, and 23, the first clamshell part 425 includes a leg 425*a*, which is supported by the shoulder 424, and a body 425*b* disposed at the upper end of the leg 425*a* (opposite the shoulder 424). The body 425*b* includes a contact 425*c* disposed in an end of a switch bore 425*d* having an open end opposite the contact 425*c*. Also disposed in the switch bore 425*d* is a switch 451 that moves (e.g., translates, slides, etc.) in the switch bore 425*d* between an on position and an off position. In the on position, the switch 451 contacts the contact 425*c* to turn on the valve 406 (e.g., to open the valve), such as through a solenoid or other electronic element. In the off position (shown in FIG. 19), the switch 451 does not contact the contact 425*c* (there is a gap between the switch 451 and the contact 425*c*) and the valve 406 is off (e.g., to close the valve). The switch 451 can be spring loaded to bias the switch 451 in one position (e.g., the off position). For example, a coil spring can be disposed in the switch bore 425*d* between the contact 425*c* and the switch 451 to bias the switch 451 away from the contact 425*c* and toward the off position. The body 425*b* also includes a semi-annular collar 425*e* that cooperates with a mating collar of the second clamshell part 426 to form an annular collar defining a pivot bore 425*f* (e.g., cavity). The collars and the pivot bore 425*f* receive a post 442 of the frame 440 to act as a pivot joint and facilitate rotation of the frame 440 relative to the clamshell parts 425, 426. As shown best in FIGS. 19 and 24, the post 442 includes a flange 443 that extends radially outward from the outer diameter of the post 442, and the flange 443 engages a channel 425*g* (e.g., an undercut recess) in the collar (e.g., the collar 425*e* and the collar of the second clamshell part 426). The flange/channel 443, 425*g* retain the spout 404 to the base while allowing relative rotation of the spout 404. Notably, the two clamshell parts 425, 426 can be symmetrically opposite, substantially symmetrically opposite (e.g., with most features being symmetrically opposite) or partially symmetrically opposite (e.g., with some features being symmetrically opposite), so the second clamshell part 426 is not discussed in greater detail.

Figure 22:
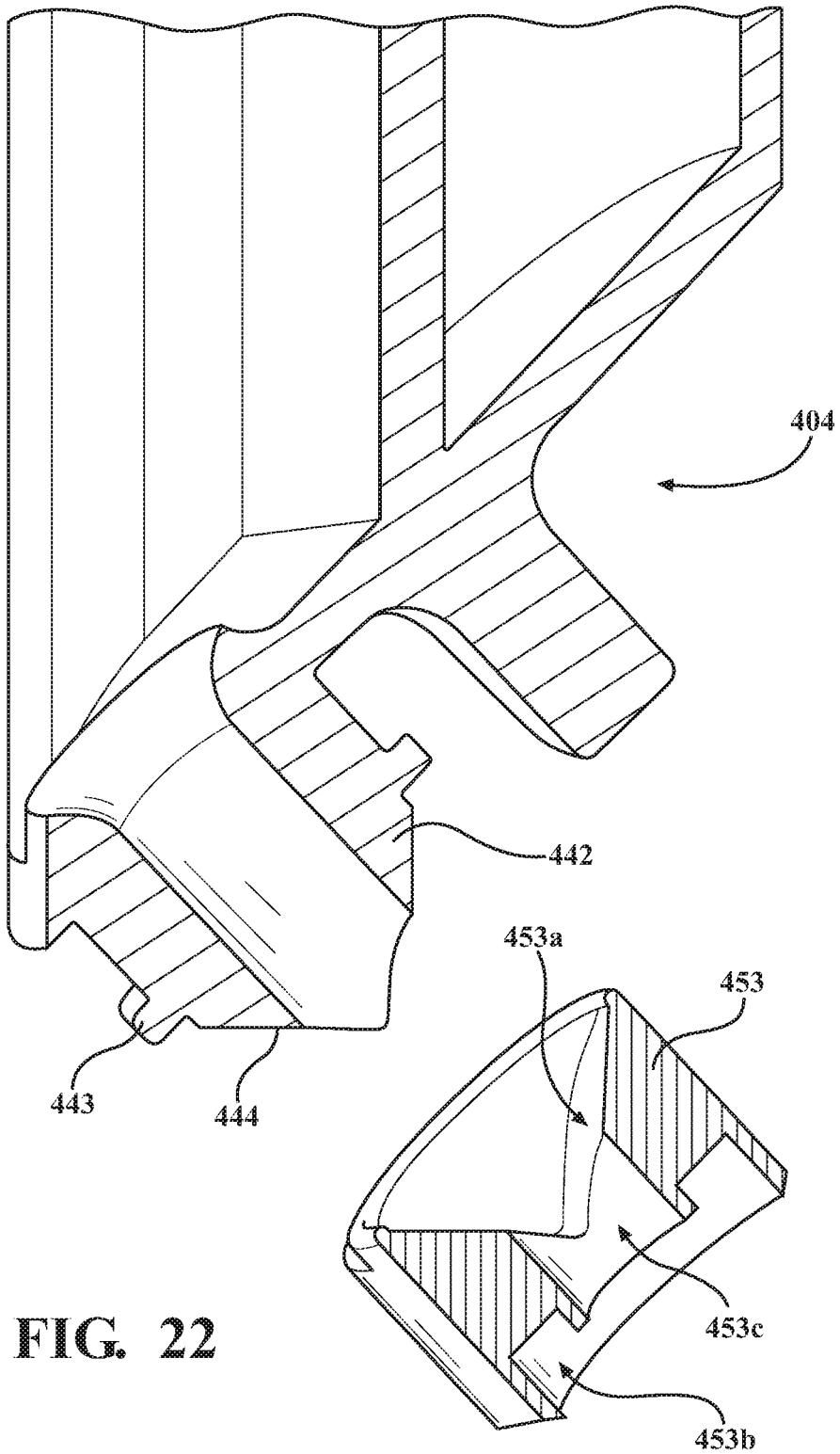
FIG. 22 is a side view of another portion of the faucet shown in FIG. 14.

Also shown in FIGS. 18 and 19, a cam block 453 having a generally cuboidal shape is disposed in the pivot bore 425*f*. As shown in FIG. 22, the cam block 453 includes an internal cam surface 453*a* that cooperates with an outer end 444 of the post 442 during rotation of the spout 404 relative to the base 402. In this way, the cam block 453 helps retain the spout 404 (through the post 442) in the on and off positions, as well as influence the spout 404 toward either the on or off position when the spout 404 is positioned somewhere between the on and off positions.

FIG. 20 shows the pivot action between a post and a cam block for a prototype faucet. This faucets disclosed herein can incorporate/utilize this pivot action. As shown, rotating the spout/post relative to the base/cam block ninety degrees (90°) from the off position toward the on position in either of the clockwise or counterclockwise directions results in the spout rotating the remaining distance to the on position through the interface of the cam of the cam block and the outer end of the post. Similarly, rotating the spout/post relative to the base/cam block ninety degrees (90°) from the on position toward the off position results in the spout rotating the remaining distance to the off position through the interface of the cam and the outer end of the post.

FIG. 21 shows the desired pivot action between a post and a cam of a faucet, according to at least one embodiment. As shown, rotating the spout/post relative to the base/cam block twenty degrees (20°) from either the off position or on position toward the other position in either of the clockwise or counterclockwise directions results in the spout rotating the remaining distance to the other position through the interface of the cam of the cam block and the outer end of the post. Thus, the cam block and the post cooperate to move the spout to the on or off position when the spout is positioned in intermittent positions relative to the base. Further, the cam block and the post cooperate to retain the spout in the on and off positions with a predetermined force, which is greater than the force to rotate the spout relative to the base in the intermittent positions. This advantageously gives the spout a feeling of being locked in the on and the off positions. The spout snaps into the on and the off positions to indicate to the user that the spout is in the position.

Figure 24:
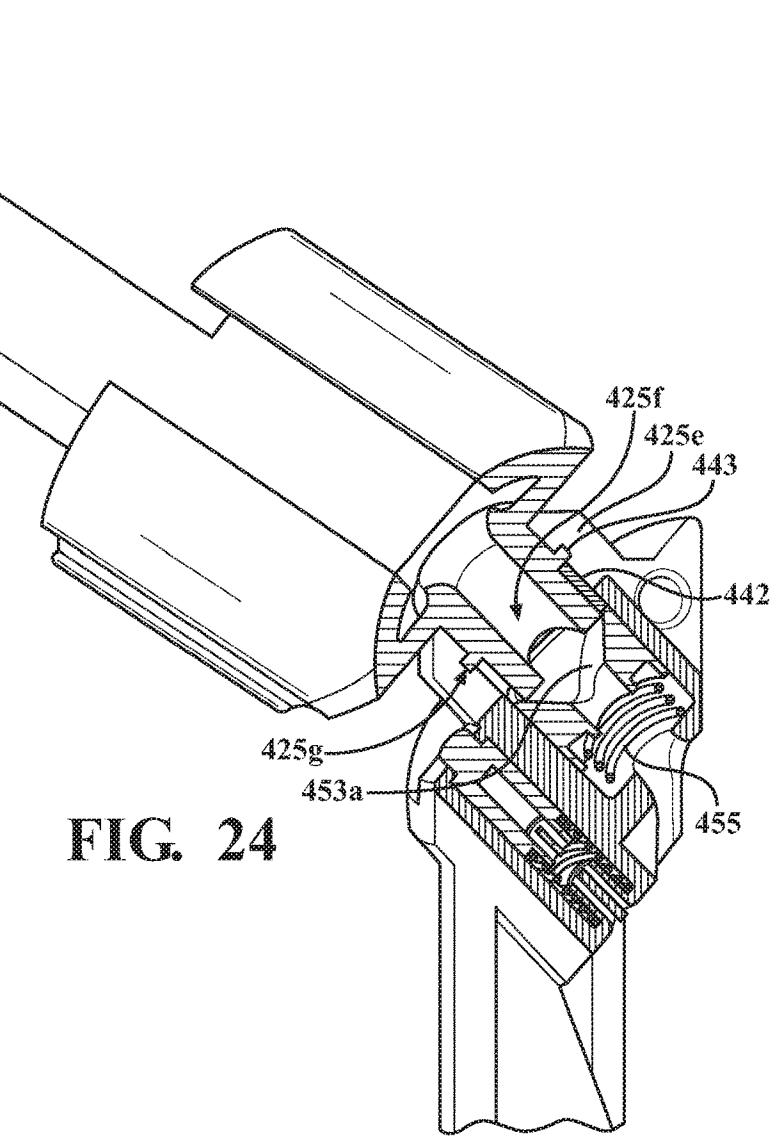
FIG. 24 is another side perspective view of the portion of the faucet shown in FIG. 23.

The cam block 453 can be spring loaded. As shown in FIGS. 19, 22, and 24, the cam block includes an annular bore 453*b* in the end opposite the cam surface 453*a*, and as shown in FIGS. 19 and 24, the bore 453*b* receives one end of a coil spring 455 that is disposed in the pivot bore 425*f*. The other end of the spring 455 contacts a surface 425*h* of the body 425*b*. When the cam block 453 is moved by the outer end 444 toward the surface 425*h*, such as during rotation of the spout 404 relative to the base 402, the spring 455 compresses to increase its spring force. When the spout 404 reaches the on/off position, the spring force from the spring 455 moves the cam block 453 away from the surface 425*h* to retain the post 442 and snap the spout 404 into the position.

Figure 25:
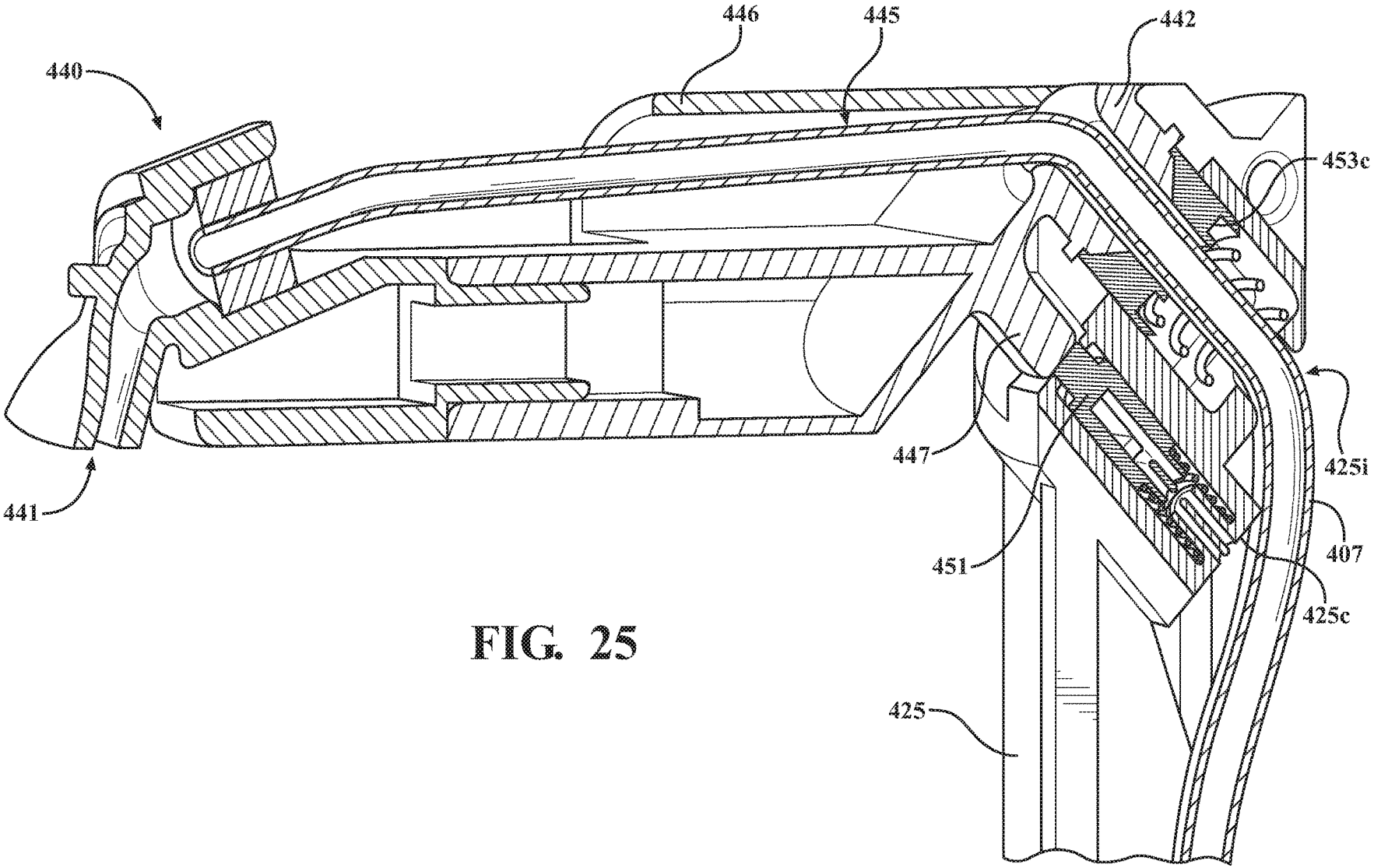
FIG. 25 is another side perspective view of another portion of the faucet shown in FIG. 14.

As shown in FIG. 25, the fluid conduit 407, if provided in the faucet, routes through a conduit bore 425*i* in the surface 425*h* of the clamshell part 425, through a conduit bore 453*c* in the cam block 453, through a bore in the post 442, and through a conduit bore 445 in the frame 440 to the outlet 441. A generally tubular portion 446 of the frame 440 defines the conduit bore 445, as shown. The post 442 is disposed at one end of the tubular portion 446 and the outlet 441 is disposed at the other end of the tubular portion 446. An outer shell of the spout 404 surrounds the frame 440. Notably, the fluid conduit 407 can be integrally formed with other components (e.g., the spout, the base, etc.) of the faucet, or the other components of the faucet can define fluid passages through which water is routed. In this way, the fluid conduit is an optional component to the faucets disclosed herein.

Figure 26:
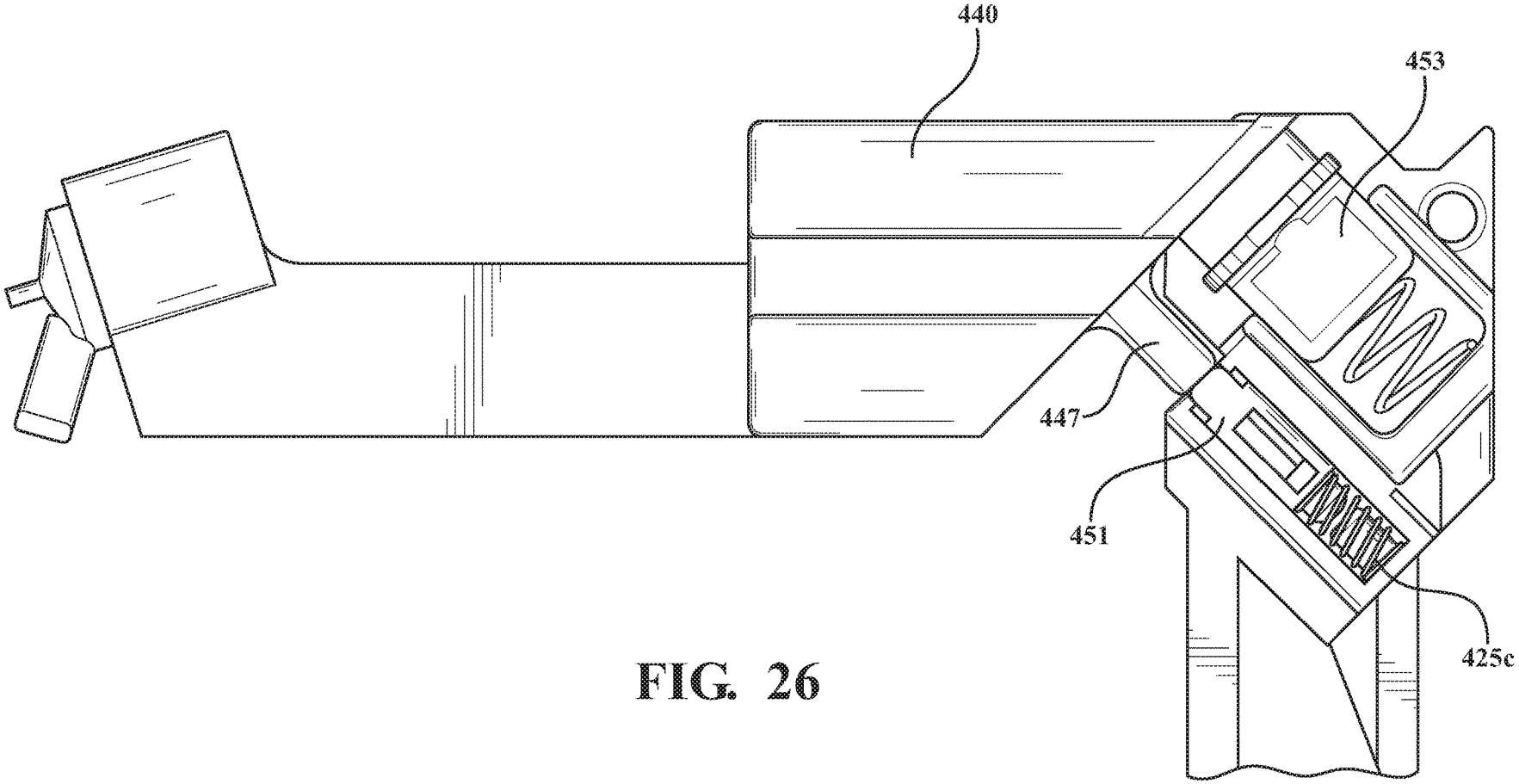
FIG. 26 is a side view of another portion of the faucet shown in FIG. 14.

As shown in FIGS. 25 and 26, when the spout 404 is moved to the on position, a projection 447 of the frame 440 moves into contact with and moves the switch 451 into contact with the contact 425*c* of the body 425 of the frame 440 to in-turn turn the switch 451 on. Water flows from the valve (e.g., solenoid valve) through the fluid conduit 407 or fluid passages to the outlet 441 in the on position of the switch 451. The projection 447 contacts and moves the switch 451 into contact with the contact 425*c* over an angular range of travel of the spout 404 relative to the base 402. According to one example, the angular range of travel is about plus/minus three degrees (+/−3°). Thus, upon rotation of the spout 404 relative to the base 402 from the off position by a rotation of one hundred seventy seven degrees in either of the clockwise or counterclockwise directions results in turning the switch on and water flowing to the outlet 441. A coil spring (e.g., similar to the spring 455) can be disposed in the switch bore 425*d* between the switch 451 and the contact 425*c* to bias the switch 451 away from the contact 425*c*, as mentioned.

Each spout 104, 204, 304, 404 can be manually rotatable relative to the base, such that a user of the faucet grabs the spout and rotates the spout (relative to the base) to control operation of the faucet (e.g., a flow of water). Alternatively, each spout 104, 204, 304, 404 can automatically rotate relative to the base, such as in response to a detection made by a sensor. Thus, one or more of the faucets disclosed herein (e.g., faucet 100, 200, 300, 400) can include one or more sensors that control operation of the faucet. By way of example, the one or more sensors can include a proximity (e.g., infra-red or IR) sensor that detects presence of a user (or part of a user, such as a hand) within a range (e.g., detection zone) of the proximity sensor, a touch (e.g., capacitive) sensor that detects contact by a user, which can be part of (e.g., embedded in) an actuator and/or controller, which can control operation of the faucet, or another suitable type of sensor. The one or more sensors can be located on or in part of the faucet, such as a spout or a base thereof, or can be located external to the faucet. The one or more sensors can automatically move the faucet between the various positions (e.g., on/off, first/second, etc.) and/or control other operations of the faucet. For example, a faucet can include a proximity sensor that moves the spout relative to the base from the off position to the on position in response to detecting presence of a user in a detection zone of the faucet. Upon no longer detecting the user's presence, the sensor (e.g., through a controller) can move the spout from the on position to the off position.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

The terms "coupled," "connected," and the like, as used herein, mean the joining of two members directly or indirectly to one another. Such joining may be stationary (e.g., permanent) or moveable (e.g., removable or releasable). Such joining may be achieved with the two members or the two members and any additional intermediate members being integrally formed as a single unitary body with one another or with the two members or the two members and any additional intermediate members being attached to one another.

References herein to the positions of elements (e.g., "top," "bottom," "above," "below," etc.) are merely used to describe the orientation of various elements in the FIGURES. It should be noted that the orientation of various elements may differ according to other exemplary embodiments, and that such variations are intended to be encompassed by the present disclosure.

The construction and arrangement of the elements of the articulating faucets as shown in the exemplary embodiments are illustrative only. Although only a few embodiments of the present disclosure have been described in detail, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements, the position of elements may be reversed or otherwise varied, and the nature or number of discrete elements or positions may be altered or varied.

Additionally, the word "exemplary" is used to mean serving as an example, instance, or illustration. Any embodiment or design described herein as "exemplary" is not necessarily to be construed as preferred or advantageous over other embodiments or designs (and such term is not intended to connote that such embodiments are necessarily extraordinary or superlative examples). Rather, use of the word "exemplary" is intended to present concepts in a concrete manner. Accordingly, all such modifications are intended to be included within the scope of the present disclosure. Other substitutions, modifications, changes, and omissions may be made in the design, operating conditions, and arrangement of the preferred and other exemplary embodiments without departing from the scope of the appended claims.

Other substitutions, modifications, changes and omissions may also be made in the design, operating conditions and arrangement of the various exemplary embodiments without departing from the scope of the present invention. For example, any element (e.g., base, spout, cam block, switch, frame clamshell parts, etc.) disclosed in one embodiment may be incorporated or utilized with any other embodiment disclosed herein. Also, for example, the order or sequence of any process or method steps may be varied or re-sequenced according to alternative embodiments. Any means-plus-function clause is intended to cover the structures described herein as performing the recited function and not only structural equivalents but also equivalent structures. Other substitutions, modifications, changes and omissions may be made in the design, operating configuration, and arrangement of the preferred and other exemplary embodiments without departing from the scope of the appended claims.

What is claimed is:

1. A faucet comprising:

a base mountable to a support;

a cam block disposed within a collar of the base;

a spout moveably coupled to the base and having an outlet for dispensing water and a post structured to engage the cam block; and a valve that controls a flow of water to the outlet;

wherein the valve is opened in response to the spout being moved relative to the base to a first position, and the valve is closed in response to the spout being moved relative to the base from the first position toward a second position; and wherein the post is rotatably coupled to the collar such that the cam block moves the spout from an intermediate position toward one of the first and second positions.

2. The faucet of claim 1, wherein each of the spout and the base is tubular, a longitudinal axis of the tubular spout is aligned with a longitudinal axis of the tubular base in one of the first position or the second position, and the longitudinal axis of the tubular spout is transverse to the longitudinal axis of the tubular base in the other of the first position or the second position.

3. The faucet of claim 1, wherein the spout is manually rotatable relative to the base by a user of the faucet.

4. The faucet of claim 1, wherein the spout automatically rotates relative to the base in response to a detection of a sensor.

5. The faucet of claim 4, wherein the sensor is one of a proximity sensor, in which the detection is presence of a user within a range of the proximity sensor, or a touch sensor, in which the detection is contact with an actuator.

6. The faucet of claim 1, further comprising a switch moveably disposed in a switch bore of the base, wherein a projection of the spout moves the switch into contact with an electrical contact to open the valve in the first position of the spout relative to the base.

7. The faucet of claim 6, further comprising a spring disposed in the switch bore between the switch and the electrical contact, wherein the spring biases the switch away from the electrical contact, so that the valve is closed in response to the switch moving out of contact with the electrical contact when the projection releases the switch after a predetermined rotation of the spout relative to the base from the first position toward the second position.

8. The faucet of claim 1, wherein the cam block includes an internal cam surface that cooperates with an outer surface of the post to move the spout in the intermediate position.

9. The faucet of claim 1, wherein the movement to open/close the valve is a first movement, the spout is movable relative to the base in a second movement that is different than the first movement, and the second movement controls a temperature of water to the outlet.

10. The faucet of claim 9, wherein one of the first movement and the second movement is rotation and the other of the first movement and the second movement is sliding.

11. The faucet of claim 10, wherein the first movement is rotation and the second movement is sliding.

12. The faucet of claim 1, wherein the movement to open/close the valve is a first movement, the spout is movable relative to the base in a second movement that is different than the first movement, and the first movement turns the flow on and off and the second movement controls a flow rate of water to the outlet.

13. The faucet of claim 12, wherein the first movement is rotation, such that the water flows to the outlet of the spout in a first rotational position of the spout relative to the base and water does not flow to the outlet in a second rotational position of the spout relative to the base, and wherein the second movement is sliding of the spout substantially along a longitudinal axis of the spout relative to the base.

14. A faucet comprising:

a base mountable to a support;

a cam block disposed within the base;

a spout moveably coupled to the base and having an outlet for dispensing water and a post structured to engage with the cam block; and a valve that controls a flow of water to the outlet;

wherein a first movement of the spout relative to the base opens/closes the valve; and wherein a second movement of the spout, which is different than the first movement, relative to the base adjusts a flow rate of the water through the valve.

15. The faucet of claim 14, wherein the first movement is rotation, the valve opens in response to rotation of the spout to a first rotational position, and the valve closes in response to rotation of the spout from the first rotational position to a second rotational position.

16. The faucet of claim 15, wherein the second movement is sliding, the flow rate increases in response to sliding the spout toward a first sliding position, and the flow rate decreases in response to sliding the spout toward a second sliding position.

17. A faucet comprising:

a base mountable to a support;

a cam block disposed within a pivot bore of a collar of the base;

a spout rotatably coupled to the base and having an outlet for dispensing water and a post structured to engage the cam block; and a valve that controls a flow of water to the outlet;

wherein the valve opens in response to at least one of a clockwise rotation and a counterclockwise rotation of the spout relative to the base to a first position;

wherein the valve closes in response to at least one of the clockwise rotation and the counterclockwise rotation of the spout relative to the base from the first position toward a second position; and wherein a longitudinal axis of the spout aligns with a longitudinal axis of the base in one of the first position or the second position; and wherein the valve opens in response to both the clockwise rotation and the counterwise rotation to the first position, and the longitudinal axis of the spout is transverse to the longitudinal axis of the base in the other of the first position of the second position.

18. A faucet comprising:

a base mountable to a support;

a cam block disposed within the base;

a spout moveably coupled to the base and having an outlet for dispensing water and a post structured to engage the cam block; and a valve that controls a flow of water to the outlet, such that the valve is opened in response to the spout being moved relative to the base to a first position, and the valve is closed in response to the spout being moved relative to the base to a second position, wherein a rotational movement of the spout operates to open the valve and to close the valve, and a sliding movement of the spout controls a temperature of water to the outlet.

19. The faucet of claim 18, wherein each of the spout and the base is tubular, a longitudinal axis of the tubular spout is aligned with a longitudinal axis of the tubular base in one of the first position or the second position, and the longitudinal axis of the tubular spout is transverse to the longitudinal axis of the tubular base in the other of the first position or the second position.

20. The faucet of claim 18, wherein the cam block includes an internal cam surface that cooperates with an outer surface of the post to move the spout.

21. The faucet of claim 18, further comprising a switch moveably disposed in a switch bore of the base, wherein a projection of the spout moves the switch into contact with an electrical contact to open the valve when the spout is move to the first position.

22. A faucet comprising:

a base mountable to a support;

a cam block disposed within the base;

a spout moveably coupled to the base and having an outlet for dispensing water and a post structured to engage the cam block; and a valve that controls a flow of water to the outlet, such that the valve is opened in response to the spout being moved relative to the base to a first position, and the valve is closed in response to the spout being moved relative to the base to a second position, wherein a first movement of the spout relative to the base operates to open the valve and to close the valve, and a second movement of the spout, different from the first movement, operates to control a flow rate of water to the outlet.

23. The faucet of claim 22, wherein the first movement is rotation, such that the water flows to the outlet of the spout in a first rotational position of the spout relative to the base and water does not flow to the outlet in a second rotational position of the spout relative to the base, and wherein the second movement is sliding of the spout substantially along a longitudinal axis of the spout relative to the base.

* * * * *